US009541086B2

(12) United States Patent
Beers et al.

(10) Patent No.: US 9,541,086 B2
(45) Date of Patent: Jan. 10, 2017

(54) LIQUID RING PUMP WITH MODULAR CONSTRUCTION, AN INTER-STAGE BYPASS AND OVERLOAD PROTECTION

(71) Applicant: GARDNER DENVER NASH LLC, Charleroi, PA (US)

(72) Inventors: Charles Howard Beers, Milford, CT (US); Ramesh Balkunge Shenoi, Orangeburg, NY (US)

(73) Assignee: GARDNER DENVER NASH LLC, Charleroi, PA (US)

( * ) Notice: Subject to any disclaimer, the term of this patent is extended or adjusted under 35 U.S.C. 154(b) by 485 days.

(21) Appl. No.: 14/076,785

(22) Filed: Nov. 11, 2013

(65) Prior Publication Data

US 2015/0093260 A1 Apr. 2, 2015

Related U.S. Application Data

(60) Provisional application No. 61/885,104, filed on Oct. 1, 2013.

(51) Int. Cl.
*F04C 19/00* (2006.01)
*F04C 29/12* (2006.01)

(52) U.S. Cl.
CPC ..... *F04C 19/005* (2013.01); *F04C 19/004* (2013.01); *F04C 19/007* (2013.01); *F04C 19/008* (2013.01); *F04C 29/12* (2013.01)

(58) Field of Classification Search
CPC ..... F04C 19/004; F04C 19/007; F04C 19/008
(Continued)

(56) References Cited

U.S. PATENT DOCUMENTS 3,351,272 A * 11/1967 Jennings ..... F04C 19/008 417/68
3,743,443 A * 7/1973 Jennings ..... F04C 19/004 417/68

(Continued)

FOREIGN PATENT DOCUMENTS

AU 429 066 B2 10/1972
GB 844055 A 8/1960

OTHER PUBLICATIONS

Pending, related Design U.S. Appl. No. 29/472,245, filed Nov. 11, 2013 (13 pgs.).

(Continued)

*Primary Examiner* — Peter J Bertheaud
(74) *Attorney, Agent, or Firm* — Michael Best & Friedrich LLP

(57) ABSTRACT

A modular liquid ring pump has a liquid ring overload protection system including a passage from a working chamber directly to the pump discharge passage and a mechanical relief valve configured to release liquid from the working chamber during compressor overload. The liquid ring pump, when configured to have two stages, has an inter-stage by-pass system that includes an opening in an inter-stage passage and a pressure sensitive mechanical valve that allows the discharge of a first stage compressor to flow directly to the pump discharge at start up or during low pressure operation. The liquid ring pump's modular construction may be easily configured from a single stage pump to a two-stage pump and vice versa by using the same bearings, head, and drive system and only changing the body, cone, and rotor.

11 Claims, 7 Drawing Sheets

(58) Field of Classification Search
USPC ..... 417/68
See application file for complete search history.

(56) References Cited

U.S. PATENT DOCUMENTS

| | | | | |
|---|---|---|---|---|
| 3,837,764 | A | 9/1974 | Fritch et al. | |
| 4,323,334 | A * | 4/1982 | Haavik | F04C 19/004 417/68 |
| 4,498,844 | A * | 2/1985 | Bissell | F04C 19/008 417/68 |
| 5,356,268 | A | 10/1994 | Lengyel et al. | |
| 6,354,808 | B1 | 3/2002 | Shenoi et al. | |

OTHER PUBLICATIONS

International Search Report corresponding to related PCT/US2014/042546, dated Nov. 17, 2014 (7pgs).
Writen Opinon of the International Searching Authority corresponding to related PCT/US2014/042546, dated Nov. 17, 2014 (12pgs).
PCT/ISA/206, Partial International Search and restriction requirement related to companion international case PCT/US2014/042546, mailed Sep. 3, 2014 (6 pgs.).
"Operation and Maintenance Manual No. 524-C—Nash Two-Stage Vacuum Pump AT2004," Jan. 1, 1998, Nash Engineering Company (53 pages); Note: figs. 1-1, 1-3, pp. 1-2.

* cited by examiner

LIQUID RING PUMP WITH MODULAR CONSTRUCTION, AN INTER-STAGE BYPASS AND OVERLOAD PROTECTION

CROSS-REFERENCE TO RELATED APPLICATIONS

None.

BACKGROUND OF THE INVENTION

Field of the Invention

The present invention is in the field of liquid ring pumps.

Description of Related Art

Liquid ring pumps are well known. Liquid ring pumps include a housing that defines at least one working chamber, a rotor within the housing having a plurality of impellers extending radially outward from the shaft and within the working chambers, a shaft extending into the housing wherein the rotor is fixed to the shaft, and a drive system such as a motor operably connected to the shaft. Drive system may be an induction motor, gas motor, or any other drive system or motor known in the art. The rotor and shaft are positioned eccentrically within the working chamber. The working chamber is partially filled with an operating fluid and when the motor drives the shaft and the rotor, a liquid ring is formed on the inner surface of the radially outer wall of the chamber. The rotor and shaft are also eccentric to the formed liquid ring. The space defined between impellers and between the shaft and liquid ring comprises a bucket. In the portion of the ring wherein the liquid diverges from the rotor, the resulting increase in area of the bucket during rotation of the shaft results in a reduced pressure that acts as a fluid intake zone. The increase in pressure due to the reduction in the volume of the bucket during rotation of the shaft comprises a fluid compression zone.

Liquid ring pumps may have a single stage comprising a single working chamber and rotor. In addition, liquid ring pumps may be two-stage which includes a second working chamber which intakes the discharge of the first working chamber to provide a higher pressure discharge.

SUMMARY OF THE INVENTION

A modular liquid ring pump has a liquid ring overload protection system including a passage from a working chamber directly to the pump discharge passage and a mechanical relief valve configured to release liquid from the working chamber during compressor overload. The liquid ring pump, when configured to have two stages, has an inter-stage by-pass system that includes an opening in an inter-stage passage and a pressure sensitive mechanical valve that allows the discharge of a first stage compressor to flow directly to the pump discharge at start up or during low pressure operation. The liquid ring pump's modular construction may be easily configured from a single stage pump to a two-stage pump and vice versa by using the same bearings, head, and drive system and only changing the body, cone, and rotor.

BRIEF DESCRIPTION OF THE SEVERAL VIEWS OF THE DRAWING

The accompanying drawings form a part of the specification and are to be read in conjunction therewith, in which like reference numerals are employed to indicate like or similar parts in the various views.

DETAILED DESCRIPTION OF THE INVENTION

The following detailed description of the present invention references the accompanying drawing figures that illustrate specific embodiments in which the invention can be practiced. The embodiments are intended to describe aspects of the present invention in sufficient detail to enable those skilled in the art to practice the invention. Other embodiments can be utilized and changes can be made without departing from the spirit and scope of the present invention. The present invention is defined by the appended claims and, therefore, the description is not to be taken in a limiting sense and shall not limit the scope of equivalents to which such claims are entitled.

Figure 1:
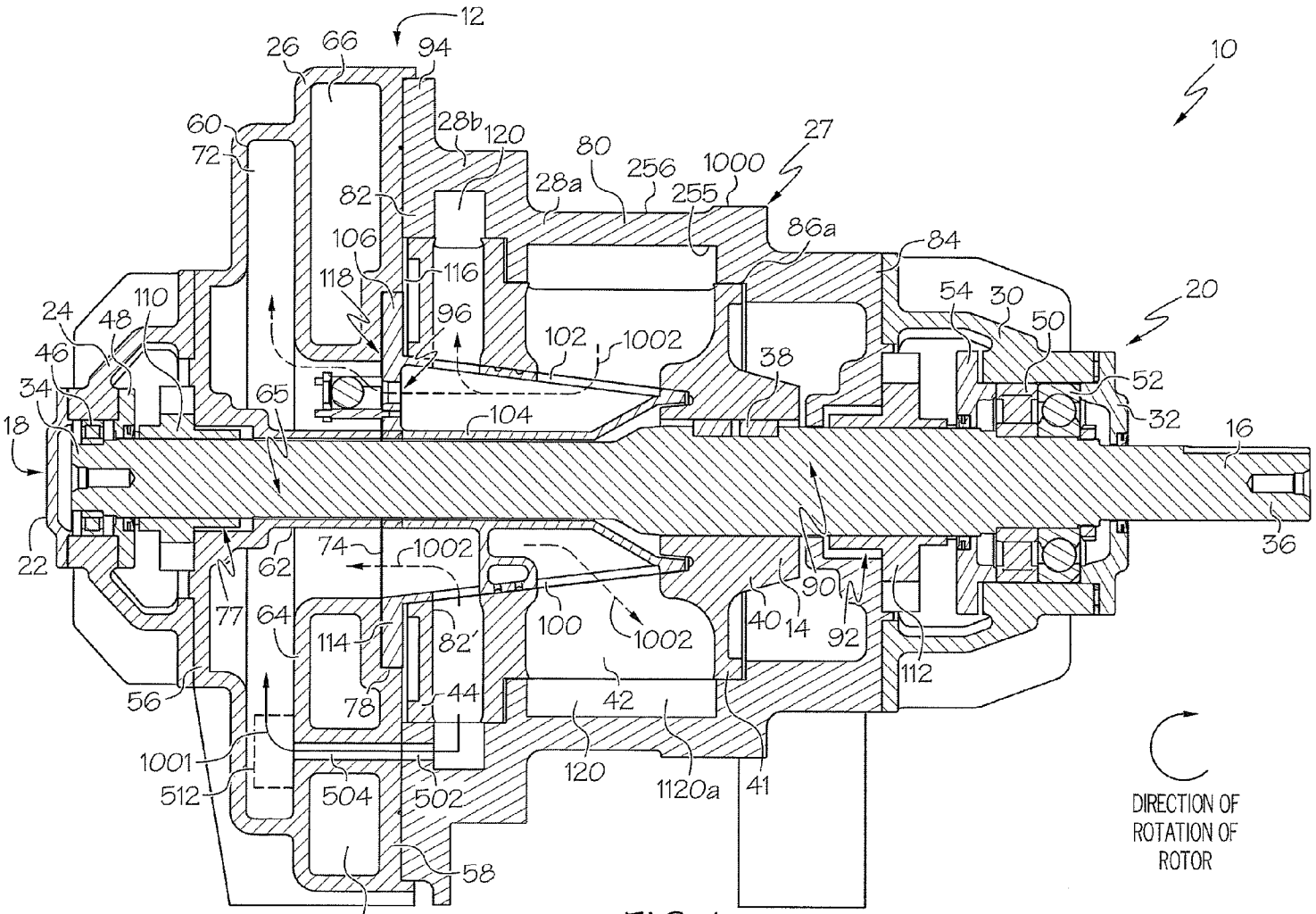
FIG. 1 is an irregular sectional view of a two stage modular liquid ring pump in accordance with the teachings of the present invention.

As illustrated in FIG. 1, the present invention is directed towards a liquid ring pump 10 having a housing 12, rotor 14, shaft 16, first end 18 and a second end 20. The liquid ring pump shown is a two stage liquid ring pump. The first end 18 is at the gas intake end of the pump 10. The gas intake end can also be called the outboard end of the pump. The second end 20 is at the drive end of the pump 10. The drive end can also be called the inboard end of the pump 10. The housing 12 comprises a first end cap 22 removably coupled to a first end bearing support 24. First end bearing support 24 is removably coupled to a head 26. Head 26 is removably coupled to a body 27. The body is a two stage body. It has a first stage body section 28*a* and a second stage body section 28*b*. Housing 12 further comprises a second end bearing support 30 removably coupled to body 27 and a second end cap 32 removably coupled to second end bearing support 30. The first end bearing support 24 and first end cap 22 are at the first end 18 of the pump 10. The second end bearing support 30 and second end cap 32 are at the second end 20 of the pump. The phrase liquid ring pump is broad enough to include a liquid ring pump configured to operate in connection with a compressor application, a liquid ring compressor. The phrase is also broad enough to encompass a liquid ring pump configured to operate in connection with a vacuum application, liquid ring vacuum pump. Of course a liquid ring vacuum pump could be used in a compressor application and a liquid ring compressor could be used in vacuum application.

Shaft 16 includes a first end 34 and a second end 36 axially opposite the first end 34. The first end 34 is axially more towards the first end 18 of the pump relative second end 36. The second end 36 is axially more towards the second end 20 of the pump relative first end 34. The terms axial and radial as used herein are relative to the long axis of shaft 16. Rotor 14 is fixedly mounted on shaft 16 using rotor key 38. Rotor 14 includes hub 40 having a first radially extending wall 41 which forms a first shroud bounding impeller 42 at an axial end. It bounds impeller 42 at an axial end of impeller 42's first impeller 42*a*. The rotor has a second radially extending wall 44 which forms a second shroud bounding an end of impeller 42 at an axial end, opposite the end bounded by wall 41. It bounds impeller 42 at an axial end of impeller 42's second impeller 42*b*. Impeller 42, including first impeller 42*a* and second impeller 42*b*, span between the first shroud 41 and the second shroud 44 and is bounded at axial ends by first 41 and second 44 shrouds. Impeller 42, including first impeller 42*a* and second impeller 42*b*, have impeller blades which extend radially from and about the circumference of shaft 16. Blades of impeller 42, including the blades of first impeller 42*a* and second impeller 42*b*, may all be distributed equidistant around shaft 16. Shaft 16 is journaled for rotation about its long axis and extends into housing 12. First end 34 of shaft 16 is journaled for rotation by a first end bearing 46. First end bearing 46 may be a radial bearing and is enclosed within bearing support 24 by first end cap 22 and a first end inner cap 48.

Shaft 16 may also be journaled for rotation by a second end radial bearing 50 proximate the second end 36 of shaft 16. A second end axial bearing 52 may also be provided proximate the second end radial bearing 50 to accommodate axial loading in the shaft 16 during rotation. The second end radial bearing 50 and axial bearing 52 may be enclosed in second end bearing support 30 by second end cap 32 and second end inner cap 54. A portion of shaft 16 extends out of housing 12 and through end cap 32. The portion may be configured to engage, directly or indirectly, a prime mover such as an electric, pneumatic, fuel powered, or hydraulic drive motor or engine.

As shown in FIG. 1, head 26 comprises a first sidewall 56, a second sidewall 58, an outer wall 60, an inner wall 62, and an interior divider wall 64. The first and second sidewalls are walls which delimit the head 26 going in the axial direction of the axis of the shaft. Starting from an interior center of the head, wall 56 delimits the head 26 in the axial direction going from the second end 20 towards first end 18 of the pump. Starting from the interior center of the head, wall 58 delimits the head in the axial direction going from the first end 18 towards second end 20 of the pump. Outer wall 60 delimits the head in the direction going radially outward from the shaft 16 axis. Inner wall 62 delimits the head 26 in the radial direction going from the outer wall 60 towards the inner wall 62. The inner wall 62, relative to the shaft 16 axis, is more radial inward than the outer wall 60. Head 26 comprises a shaft opening 65 for shaft 16 to pass through head 26.

Figure 4:
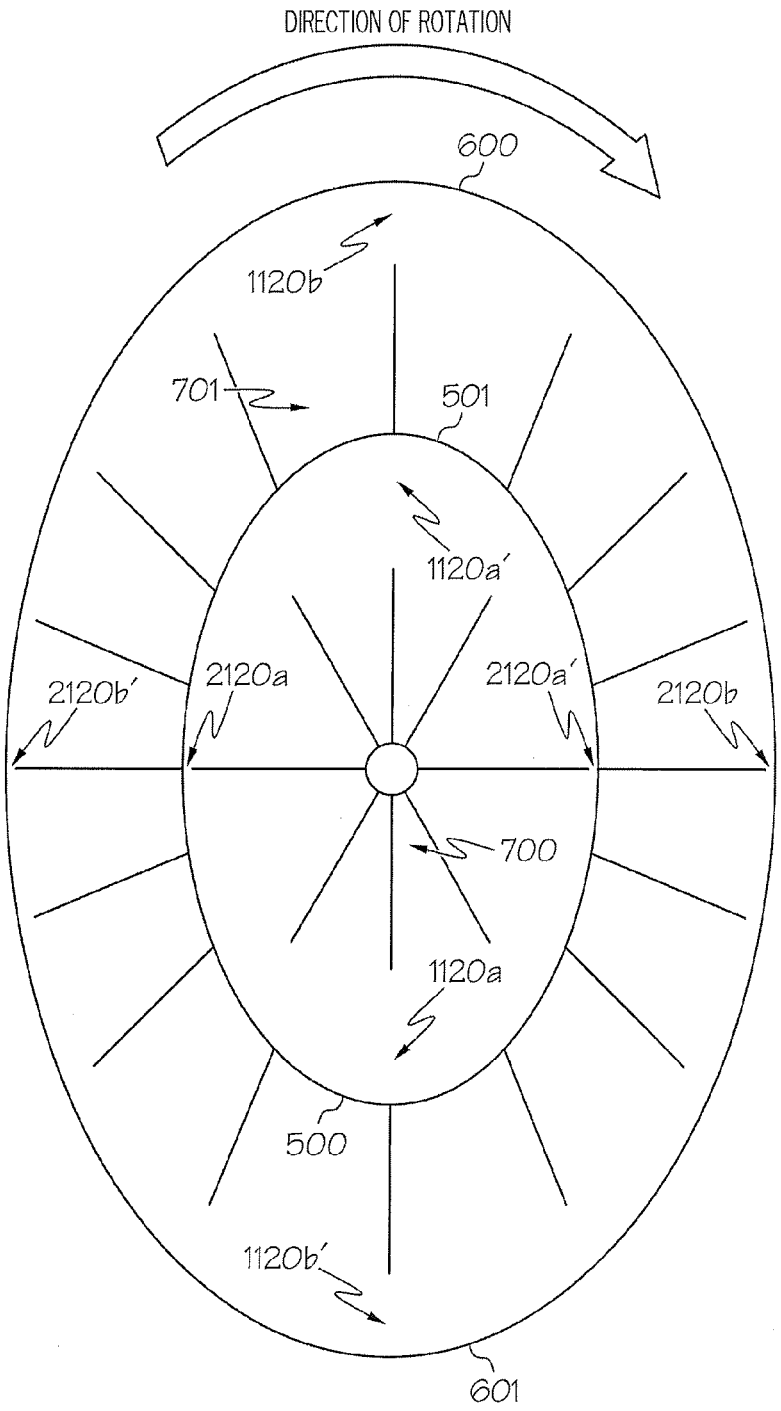
FIG. 4 is a simplified schematic view looking into two-stage body from the second end of the pump and looking into the nose of the cone of FIG. 1 with parts of the body cut away and exaggerated and omitted to exemplify that the first and second stage working chambers are elliptical and each have two lobes.
Figure 5A:
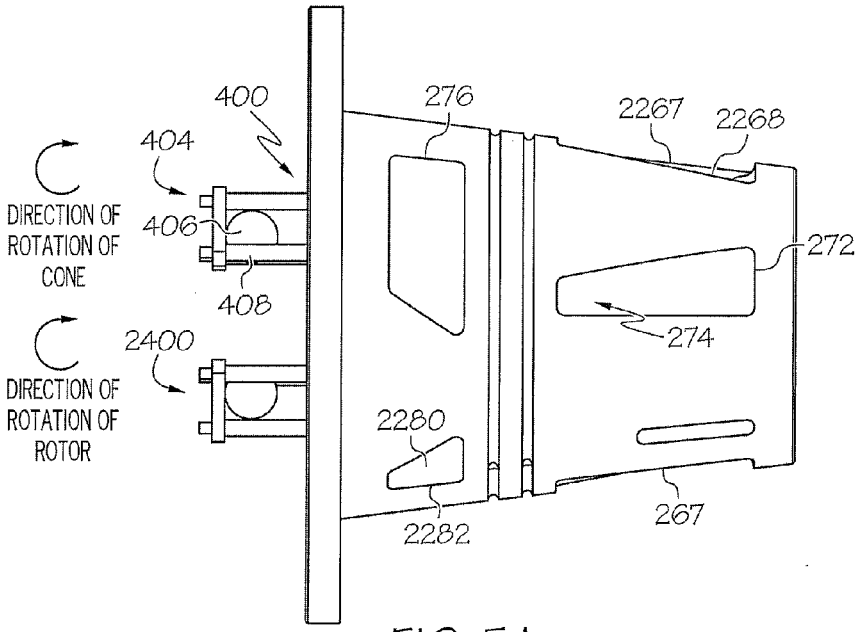
FIG. 5*a* is a first side view of the cone of the pump of FIG. 1.
Figure 5B:
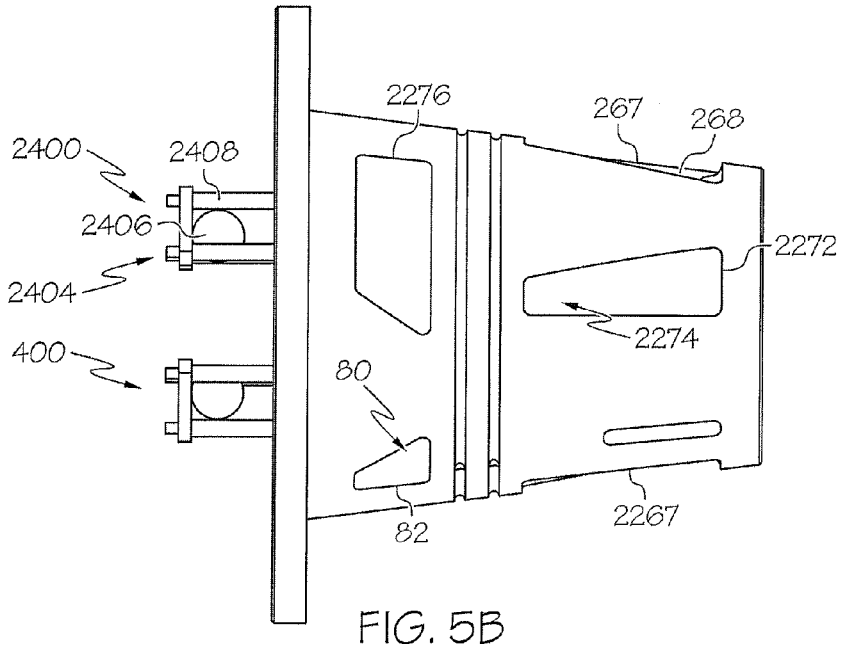
FIG. 5*b* is second side view of the cone of FIG. 1 rotated 180 degrees as compared to FIG. 5*a;*
Figure 6:
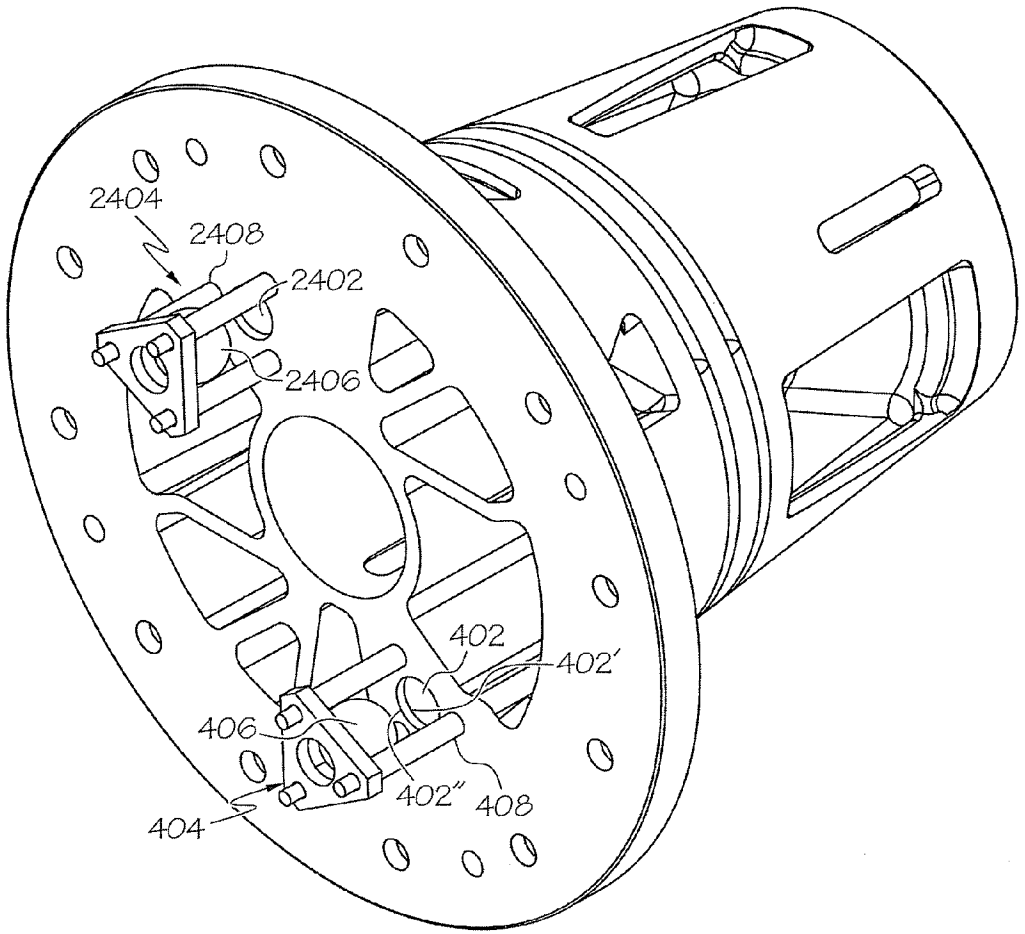
FIG. 6 is an end view of the cone of FIG. 1.
Figure 7:
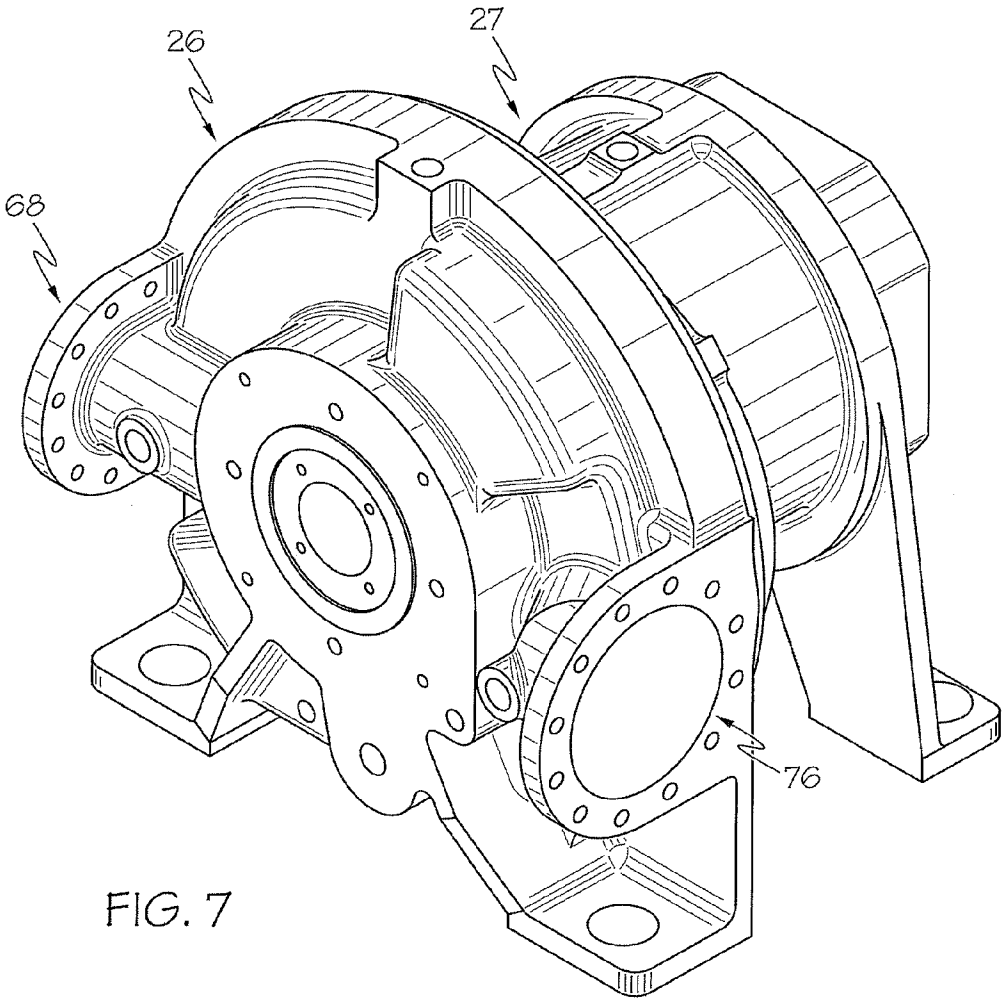
FIG. 7 is an isometric view of the pump housing of the pump of FIG. 1 exclusive of the bearing supports and end caps.

Head 26 includes a gas inlet passage 66 defined by outer wall 60, second side wall 58, and interior divider wall 64. Gas inlet passage 66 of head 26 also includes an intake opening 76 (as shown in FIG. 4) and an outlet opening (not shown) into cone 100. Head 26 also includes a gas discharge passage 72 defined by outer wall 60, first sidewall 56 and interior divider wall 64. Discharge passage 72 also includes a gas discharge opening 74 in second sidewall 58. FIG. 8 shows the intake opening 76 of inlet passage 66 on housing 12 and a discharge outlet 68 of discharge passage 72 on housing 12 where the fluid, typically gas, enters and exits the pump head 26 respectively. Turing back to FIG. 1, head 26 also comprises a recessed sealing area 77 in first sidewall 56 and a recessed cone seating surface 78 in a portion of second side wall 58. Recessed cone seating surface 78 may be a recessed portion of second sidewall 58 having complementary dimensions to a flange 106 of cone 100 to seat cone 100 (described in more detail below).

Body 27 includes a wall 80, a first sidewall 82, and a second sidewall 84 that defines chamber 120. In this case working chamber 120 includes first stage working chamber 120*a* and second stage working chamber 120*b*. Wall 80 forms a continuous curve around axis of shaft 16. The wall includes a curved radial outer surface 256 and a curved radial inner surface 255. Body 27 includes rotor sealing surface 86*a* which may be a continuously curved ledge on the inner surface 255 of wall 80 as shown. First sidewall 82 has a radially extending flange portion 94 and an opening 96 sized to accommodate cone 100 and rotor 14. Second sidewall 84 includes a shaft opening 90 and a recessed seal area 92 surrounding shaft opening 90.

Cone 100 is removably coupled to head 26 and disposed within body 27 to help direct the flow of fluid through pump 10. Cone 100 comprises an outer wall 102, an inner wall 104, and a flange 106, and is seated on cone seat surface 78 and removably coupled to head 26. Inner wall 104 and outer wall 102 are configured to direct the flow of fluid into and out of working chamber 120 of pump 10 as further described below. Flange 106 is orientated to extend radially outward from the outer wall 102 and in some locations may also span from said inner wall 104 to said outer wall 102 when such portion 118 of flange 106 of said cone is closed. Flange 106 may also function as a cone end plate. Flange 106 may have a head side 114 that abuts second sidewall 58 of head 26 at cone seat surface 78. Flange 106 may also have a side 116 facing second end 20 of pump 10.

To seal the housing 12, a first end seal 110 is disposed around shaft 16 and received into recessed seal area 77 to seal shaft opening 65 of first sidewall 56 of head 26. Similarly, a second end seal 112 is disposed around shaft 16 and received into an open area formed by recessed seal area 92 to seal shaft opening 90. The liquid ring pump 10 operates in a known manner to compress a fluid, most commonly gas, such as for example fumes exhausted by a fuel refinery or ambient air, by drawing fluid into the intake passage 66 of the head 26, from the passage 66 the fluid is drawn into cone 100. The fluid passes through cone 100 through cone fluid inlet passage 268 and out cone inlet 267 and into chamber 120 and more particularly into first stage working chamber 120*a* and even more particularly into the first gas intake zone 1120*a* in the first stage 120*a* in the first lobe 500 formed by first stage body section 28*a*. The fluid exits working chamber 120, and more particularly second stage working chamber 120*b* and even more particularly first compression zone 2120*b*. It exits by entering cone 100 through cone outlet port 278. The fluid from outlet port 278 enters cone outlet passage 280. From passage 280, the fluid enters the head outlet passage 72 through head inlet 74. From the discharge passage 72 it exits pump head 26 through discharge outlet 68.

Body 27, as stated, is a two stage body which has a first stage body section 28*a* and a second stage body section 28*b*. The first stage body section 28*a* delimits the first stage working chamber 120*a*. The first stage body section 28*a* forms first lobe 500 which forms the first stage first intake zone 1120*a*. The second stage body section 28*b* delimits the second stage working chamber 120*b*. The second stage also forms the second stage first lobe 600. The first stage working chamber 120*a* has a liquid ring portion 254. Two-stage body 27 includes a first wall step 1000 at rotor sealing surface 86*a*. Rotor sealing surface 86*a* is a first stage rotor sealing surface. Two-stage body 27 also includes a second stage rotor sealing surface 86*b* which is at a second outer wall step 260. The second stage working chamber 120*b* has a second liquid ring portion 264. Liquid ring portions 254 and 264 are the portion of chambers 120*a* and 120*b* into which the liquid in the chamber is at least partially centrifugally distributed to when the shaft 16 and rotor 14 is rotated.

The cone 100 is a two-stage cone 100. The cone inlet passage 268 is a first-stage inlet passage 268. Cone inlet 267 is a first stage inlet. Two-stage cone 100 also includes a first stage discharge port 272 in fluid communication with an inter-stage passage 274 in the cone 100. Inter-stage passage 274 is in fluid communication with a second stage inlet port 276 in the cone 100. Inter-stage passage 274 puts the first stage working chamber 120*a*, and more particularly the first compression zone 2120*a* of the first working chamber 120*a*, in fluid communication with the second stage working chamber 120*b* of the liquid ring pump 10 and more particularly the first intake zone 1120*b* of the second stage 120*b*. The discharge outlet port 278 of cone 100 is a second stage discharge outlet port 278 which leads to discharge passage 280 in cone 100. Discharge passage 280 terminates at discharge passage outlet 282 of cone 100 which is in fluid communication with discharge inlet opening 74 of head 26. One or more divider walls 284 is disposed between outer wall 102 and inner wall 104 of cone 100 to divide the inlet passage 268, inter-stage passage 274, and discharge passage 280. The dashed arrows 1002 show the flow of compressible fluid, such as ambient air, as it passes through various channels.

Rotor 14 is a two stage rotor. As stated, the impeller 42 has a first impeller 42*a* which is a first stage impeller. The first stage impeller 42*a*, having first stage blades, spans from wall 41 to a divider wall 300 and is bounded by divider wall 300 and wall 41. Two-stage rotor 14 also includes the second impeller 42*b* which is a second stage impeller. The second stage impeller 42*b*, having impeller blades, spans from divider wall 300 to an end wall 44 and is bounded by divider wall 300 and end wall 44.

Figure 2:
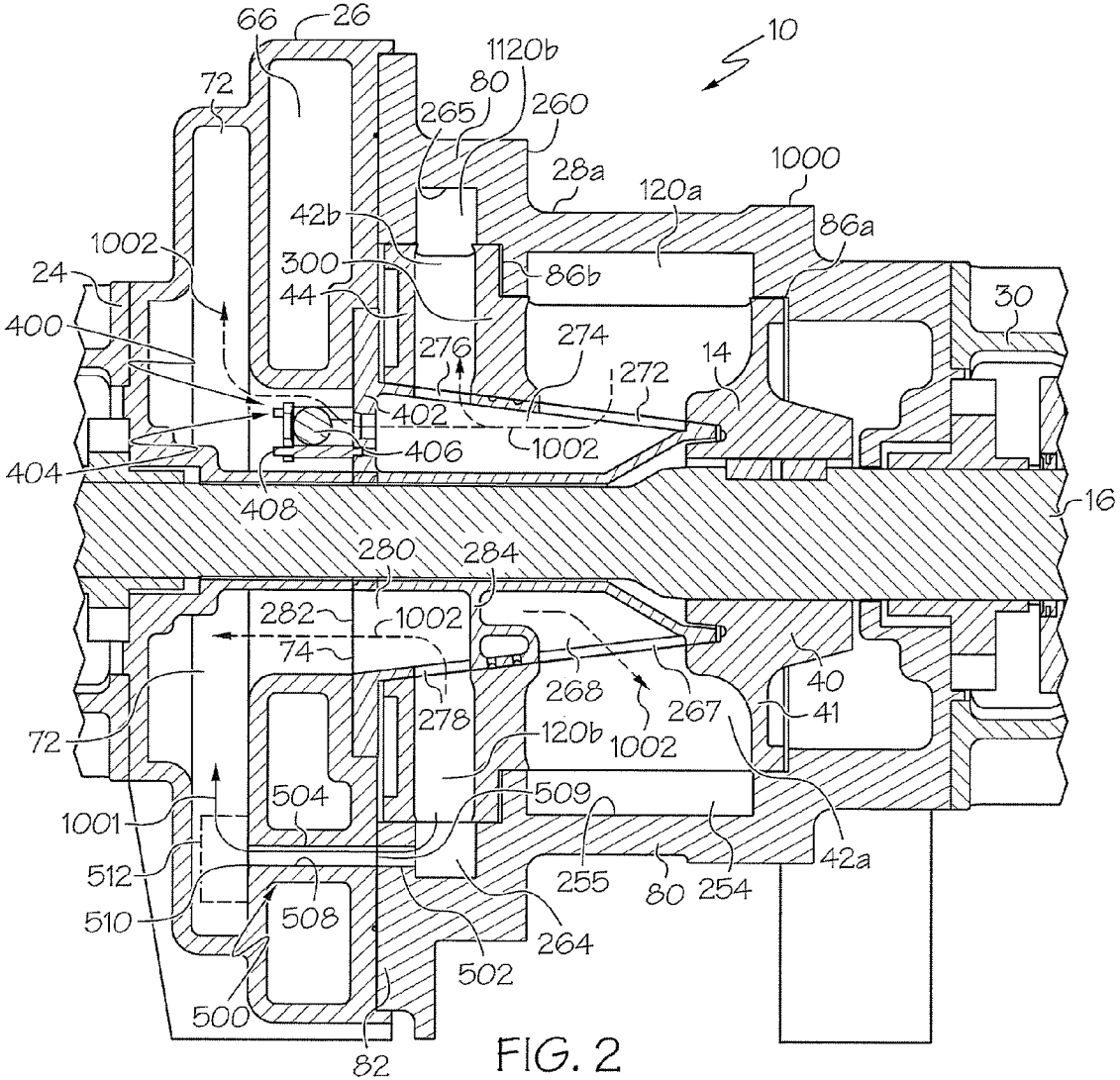
FIG. 2 is the same irregular sectional view of FIG. 1.

As further shown in FIG. 2, to allow for more efficient lower-pressure operation of liquid ring pump 10, liquid ring pump 10 includes an inter-stage discharge bypass system 400 integrated into cone 100 which allows air to discharge from first stage chamber 120*a* through inter-stage passage 274 out to discharge passage 72 of head 26 until a certain pressure is present in the discharge passage 72 to close the by-pass system 400 forcing and directing discharge of first chamber 120*a* into second chamber 120*b*. The air discharged is taken in from the first intake zone 1120*a* of the first stage 120*a*. This feature is desirable at start-up of liquid ring pump 10 in a two-stage configuration as it automatically allows liquid ring pump 10 to come up to pressure in a more efficient manner. It is also desirable in low pressure applications which do not need a second stage.

Bypass system 400 includes a bypass passage 402 in flange 106 of cone 100 that is in fluid communication with both inter-stage passage 2 and discharge passage 72 of head 26 to allow fluid flow there-through. Bypass passage 402 may be a hole in flange 106. The hole can have a diameter. Bypass system 400 also includes a mechanical valve 404 operably connected to bypass passage 402 wherein mechanical valve 404 is open when the pump 10 is in operation at start up or in low pressure applications. The pressure at the inlet 402' opening into passage 402 from inter-stage passage 2 is greater than the pressure in the discharge passage 72. The difference in pressure ensures that the valve 404 stays open and fluid flows out the inter-stage, through passage 402 and into passage 72. Bypass passage 402 is positioned such that the fluid flow may continue linearly from inter-stage passage 2 as opposed to having to turn to be diverted into second working chamber 120*b* through second stage inlet 276.

One embodiment of mechanical valve 404 shown in FIG. 2 includes a ball 406 in a cage 408. Ball 406 has a diameter larger than that of passage outlet 402" of passage 402. Ball 406 is slideable within cage 408 wherein when pump 10 begins operation, the positive pressure generated in first chamber 120*a*, and more particularly the first compression zone 2120*a*, creates a fluid flow through by-pass passage 402 which displaces ball 406 in cage 408 away from passage outlet 402" and flange 106. Once the pressure in discharge passage 72 increases enough to create a sufficient pressure differential across the passage 402, the ball is forced back against passage outlet 402" thereby closing the bypass system. The closure forces and directs fluid flow into second chamber 120*b* from inter-stage passage 2. Ball 406 and cage 408 may also be configured to keep passage 402 open until discharge passage 72 has enough pressure or if the rotor speed is less than a certain speed. A spring can also be used to keep the valve closed until the pressure differential across the passage 402 is sufficient to open the valve. Other mechanical valves such as a check valve or pneumatic valve may also be used. A solenoid valve can be used to allow the valve to open and close based on the receipt of an electrical signal. The signal can be sent based on the detection of environmental and/or operating conditions.

In use, two-stage liquid ring pump 10 must be started prior to optimal operation. While starting the pump 10, the pressure in the discharge passage 72 of head 26 is likely close to atmospheric. As the drive system rotates shaft 16 and rotor 14, air is drawn into chamber 120*a*, compressed, and discharged into inter-stage passage 2 of cone 100. At low pressure, the air being discharged at the inlet 402' is of a higher pressure than atmospheric pressure. Thus, mechanical valve 404 is actuated such that passage 402 is open allowing the flow of air to linearly continue through the inter-stage passage 2 and through passage 402. Thus, instead of being forced into the second working chamber 120*b* through second stage inlet 276, the discharge of the first working chamber passes directly into the discharge outlet passage 72 without passing through the second stage. The pump 10 during this flow state essentially operates as a single stage pump.

As the prime mover, shaft 16 and rotor 14 come up to speed, the pressure in discharge passage 72 increases to a point greater than the pressure at inlet 402' of the bypass passage 402. At this point or at another pre-determined pressure or pressure differential, the mechanical valve 404 automatically closes passage 402 by seating against outlet 402" wherein the gas discharged from first working chamber 120*a* passes through inter-stage passage 2, changes direction, and is forced into second chamber 120*b* through second stage inlet 276. Thus during this state of operation, when the pump is at running speed, both working chambers 120*a* and 120*b* are utilized.

The position of passage 402 on flange 106 of cone 100 is such that the air flowing through inter-stage passage 2 can flow more linearly through passage 402 as opposed to having to be re-directed by turning 90 degrees, pass through second stage inlet 276 and into second stage chamber 120*b*. Thus, the air will prefer to travel in a more linear flow through channel 402 rather than being re-directed and turning to pass through second stage inlet 276 and into second stage working chamber 120*b*.

The first stage body section 28*a* and the second stage body section 28*b* each form elliptical working chambers. The elliptical nature of the working chambers means that chamber 120*a* has a first intake zone 1120*a*, a second intake zone 1120*a*', a first compression zone 2120*a*, and a second compression zone 2120*a*'. The elliptical nature also means that the second stage 120*b* has a first intake zone 1120*b*, a second intake zone 1120*b*', a first compression zone 2120*b*, and a second compression zone 2120*b*'. A first lobe 500 formed by first stage body section 28*a* forms the first intake zone 1120*a*. A second lobe 501 formed by first stage body section 28*a* forms the second intake zone 1120*a*'. First lobe 600 formed by second stage body section 28*b* forms the first intake zone 1120*b* of the second stage 120*b*. A second lobe 601 formed by second stage body section 28*b* forms the second intake zone 1120*b*' of the second stage 120*b*.

The elliptical nature of the first stage body section 28*a* and second stage body section 28*b* allows for double pumping action each time a bucket 700, 701 delimited by adjacent impeller blades of first impeller 42*a* and second impeller 42*b*, makes a 360 degree rotation around the axis of shaft 16. The air inters head 26 through inlet 76. From inlet 76, the air travels into passage 66 to which inlet 76 is in fluid communication. From passage 66 the air travels into cone first stage passage 268. The air exits from cone inlet 267 and into the first stage first intake zone 1120*a* and into the bucket 700. As the bucket sweeps past the intake zone, the bucket 700 enters the first stage first compression zone 2120*a*. At this point the air is forced out of the bucket and into inter-stage passage 274 from first stage discharge port 272. The air either enters the second stage first intake zone 1120*b* through second stage inlet port 276 or enters head 26 through the bypass system 400 as explained above. If the air enters the second stage first intake zone 1120*b* it then enters into a second stage bucket 701. The second stage bucket enters the second stage first compression zone. The air is forced from the second stage bucket and into second stage cone outlet passage 280 through second stage cone outlet 282. The air from the passage 280 enters head discharge passage 72 as explained above. The first stage bucket and the second stage bucket have just finished a first pumping action After the first pumping action, the first stage bucket 700 enters a first stage second intake zone 1120*a*'. Air enters the first stage second intake zone from a second first stage cone inlet passage 2268 and through a second first stage cone inlet 2267. As the first stage bucket sweeps past the first stage second intake zone 1120*a*' it enters the second first stage compression zone 2120*b*'. The air in the first bucket is forced through a second first stage cone discharge port 2272 and into a second inter-stage cone passage 2274. The air then enters the second stage second intake zone 1120*b*' through a second, second stage cone inlet port 2276 or the air bypasses the second stage intake zone 1120*b*' through a second bypass system 2400. The second bypass system is identical the first bypass system 400. It has a valve 2404 which includes a ball 2406 in a cage 2408. The valve 2404 is interfaced with a bypass passage 2402 just like valve 404 is interfaces with passage 402. The second valve system 2400 works with inter-stage passage 2274 and second stage inlet port 2276 just like valve system 400 works with inter-stage passage 274 and second stage inlet 276

If the air enters the second stage second intake zone 2120*b*' it enters the second stage bucket which has now rotated to the second stage second intake zone from the second stage first compression zone. The second stage second intake zone is formed by the second lobe 601 of the second stage body section 28*b*. Air in the second stage bucket is forced out of the bucket when the bucket enters the second stage second compression zone 2120*b*'. From the second stage second compression zone the air enters into a second, second stage cone outlet passage 2280 though a second, second stage cone outlet 2282. From passage 2280 the air enters head discharge passage 72.

Figure 3:
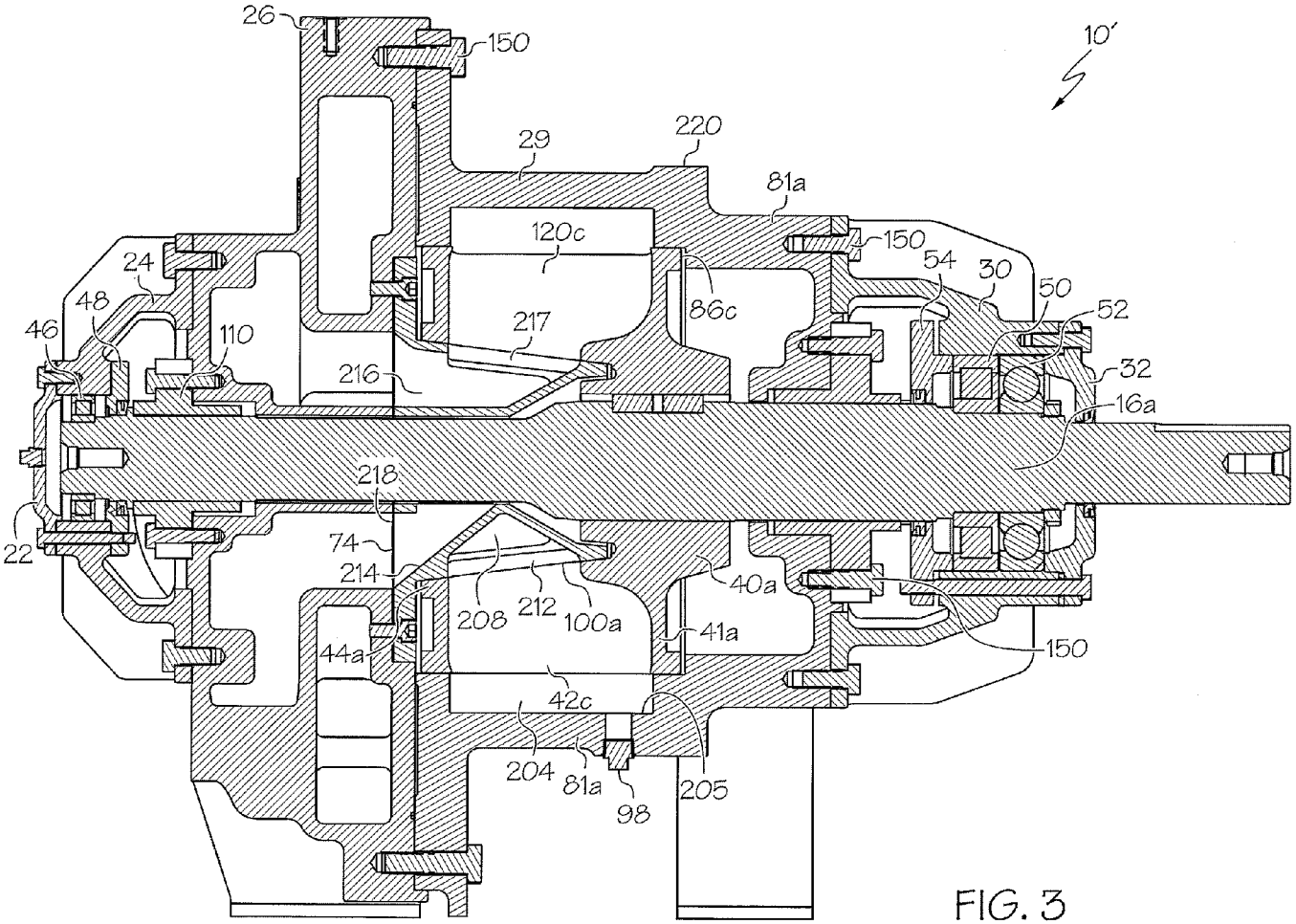
FIG. 3 is an irregular sectional view of a modular single stage liquid ring pump having many of the same components as the pump of FIG. 1 except the two stage modular components shown in FIG. 1 have been replaced with single stage modular components as shown in FIG. 3.

To prevent stalling of or damage to liquid ring pump 10 from spikes in upstream pressure or fluid carry over due to processing conditions, liquid ring pump 10 in either a single stage configuration, such as that shown in FIG. 3, or a two-stage configuration may include a liquid ring overload protection system 500 integrated into body 29 or 27 and head 26. As further shown in FIG. 2, overload protection system 500 includes a sidewall passage 502 opening from working chamber 120, and more particularly second chamber 120*b*, and more particularly second stage intake zone 1120*b* through first sidewall 82 of body 27 and being in fluid communication with liquid ring portion 264. Sidewall passage 502 may be a circular hole or hole of other shape. Sidewall passage 502 has an inlet 502' which leads into passage 502 from chamber 120, particularly second chamber 120*b*, and liquid ring portion 264. Sidewall passage 502 is in fluid communication with a formed passage 504 through head 26. Formed passage 504 is in fluid communication with discharge passage 72. Formed passage extends though second wall 58 of head 26.

Formed passage 502 and or 504 may have a divider wall that is a circular tube or tube of other shape having a passageway of a substantially similar shape of sidewall passage 502. Formed passage 504 and sidewall passage 502 are configured to align in an overlapping manner upon securing head 26 to body 27 or 29. Formed passage 504 includes an inner surface 508, an inlet 509 and an outlet 510 to discharge passage 72. Sidewall passage 502 and formed passage 504 may be collectively referred to as an overload relief passage. A mechanical valve 512 sensitive to pressure of the liquid ring on inner wall 265 of wall 80 automatically opens to release fluid into discharge passage 72 when the fluid volume or liquid ring overload pressure exceeds a pre-determined pressure. Mechanical valve 512 may be a spring valve or other mechanical pressure relief valve now known or hereafter developed. Mechanical valve 512 may be operable to close automatically when the liquid volume or overload pressure returns to normal operating conditions. The mechanical valve may be pneumatic or a check valve.

In use, as shown in FIG. 2, mechanical valve 512 remains closed during operation of liquid ring pump 10. As fluid is drawn into chamber 120, first chamber 120*a* and/or second chamber 120*b*, in some cases, liquid may be present in the gaseous fluid being drawn in and accumulate operation. Some accumulation may be within the operational range of the pump. However, if too much liquid fluid accumulates in the liquid ring portion 264, the added liquid fluid may cause an overload pressure which may cause the pump to fail or may even cause damage to the components of the pump.

As the liquid is dispersed throughout the liquid ring portion 264 of the chamber 120, particularly second chamber 120*b*, during operation, an outward centrifugal force is exerted on inner surface 255 of wall 80 and a force is exerted on an interior surface 82' of first side wall 82. Liquid in the working chamber 120, particularly 120*b*, will flow into and fill passages 502 and 504 during operation exerting a pressure upon mechanical valve 512. As fluid builds up in the working chamber 120, particularly 120*b*, the centrifugal force exerted by the mass of water will increase. At a pre-determined pressure caused by the centrifugal force of the fluid in chamber 120, particularly 120*b*, the mechanical valve 512 will open allowing fluid in the fluid ring to escape directly into discharge passage 72 of head 26 and out of the pump 10. When a sufficient volume of fluid has been released to reduce the centrifugal pressure in the working chamber 120, particularly 120*a* and 120*b*, to a pre-determined maximum operational value, then mechanical valve 512 closes; liquid no longer flows through passages 502 and 504 into passage 72. This process may repeat itself throughout the operation of pump 10 depending upon the liquid content of the gas being compressed. The liquid flow is shown by arrow 1001

The pump may have a second overload protection system. The system would have a passage opening a second intake zone which could be a second intake zone in a second stage. The passage would open through first side wall 82 just like passage 502. The passage would be in fluid communication with head passage 72. It would be in fluid communication with a passage through wall 58. The passage through wall 58 would be just like passage 504. It would have a mechanical valve just like valve 512. The system would work just like system 500.

As shown in FIG. 3, a single stage body 29 of single stage liquid ring pump 10' is used with first end bearing support 24, head 26, second end bearing support 30 and the same prime mover as used with two stage liquid ring pump 10. The body 29 is coupled to head 26 with fasteners 150. The second bearing support 30 and the first bearing support 24 are coupled with fasteners 150 to body 29. The same fasteners may be used to couple head 26 to body 27 and to couple first bearing support 24 and second bearing support 30 to body 27. The fasteners 150 may be bolts, clamps, screws, or other known fastener in the art, or any combination thereof. Single stage body 29 includes a single stage working chamber 120*c* which has a liquid ring portion 204. Liquid ring portion 204 is the portion of chamber 120*c* into which the liquid in the chamber is centrifugally distributed to when a single stage rotor 14*a* is rotated. Liquid ring portion 204 extends from an inner surface 205 of outer wall 81*a* radially inward a distance depending upon the volume of fluid present in the chamber 120*c*. Body 29 or 27 may include one or more drain plugs 98, shown in FIG. 3 to drain one or more chambers.

A single stage cone 100*a* is installed to be in fluid communication with head 26 and single stage body 29. Single stage cone 100*a* includes an inlet passage 208, an inlet port and an outlet port 212 from the inlet passage. First stage inlet passage 208 is in fluid communication with inlet passage 66 of head 26 and first stage outlet 212 is in fluid communication with single stage chamber 120*c*. Single stage cone 100*a* includes divider wall 214 which separates the inlet passage 208 from a discharge passage 216 of cone 100*a*. Discharge passage 216 of cone 100*a* includes a discharge passage inlet 217 and a discharge passage outlet 218. Discharge passage inlet 217 is in fluid communication with single stage chamber 120*c* and discharge passage outlet 218 is in fluid communication with discharge inlet opening of head 26 leading into discharge passage 72 of head 26.

As further shown in FIG. 3, single stage body 29 also includes an outer wall step 220 corresponding to the location of the first stage rotor seal area 86*c* which seals along first wall 41*a*, first shroud, of first stage impeller 42*c*. The impeller 42*c* is mounted on a single-stage shaft 16*a*. The single stage shaft has a length configured for single working chamber 120*c*. The impeller 42*c* forms part of single stage rotor 14*a*. The rotor includes a hub 40*a*. The wall 41*a* of rotor 16*a* extends radially from hub 40*a*. The wall 41*a* is an end wall. A second wall, 44*a*, second shroud, forms part of rotor 16*a* is at an end axial opposite the first wall 44*a*. The walls 44*a* and 41*a* bound impeller 42*c* at opposite axial ends. The impeller blades extend radially from and about single-stage shaft 16*b*. The impeller 42*c* and impeller blades span from wall 41*a* to end wall 44*a*. The impeller blades of impeller 42*c* extend radially away form and about single stage shaft 16*a*.

Body 29 may be elliptical just like body 27. The elliptical construction would mean that the body forms a first lobe and a second lobe. The first lobe would form a first intake zone. The second lobe would form a second intake zone. The cone would have a second cone inlet passage leading into a second cone inlet. The cone would have a second discharge port leading into a second discharge passage. The first inlet 212 would open into the first intake zone 1120*c*. The second inlet would open into the second intake zone. The second discharge passage would open into head outlet passage 72.

Liquid ring pump 10 allows for a modular construction wherein liquid ring pump 10 may be easily changed between a two-stage pump and single stage pump (or vice-versa) simply by replacing the body 27, the cone 100, the rotor 14 and the shaft 16. Also piping would be changed. Put another way the configurations of single-stage body 29, cone 100*a*, rotor 14*a*, and shaft 16*a* and two-stage body 27, cone 100, rotor 14 and shaft 16 are such that two-stage pump 10 of the present invention can easily be converted into a single-stage pump 10' of the present invention and vice versa without having to change the head 26, bearing supports 24 and 30, radial bearings 46, 52, axial bearing 50, end caps 22, 32, inner caps 48, 54, seals 110 and 112, prime mover, wiring, or and other fixed components. These components are common to both the single stage 10' and two stage pump 10, For example, to convert liquid ring pump 10 from a two stage compressor to a single stage compressor, a technician may remove second end cap 32 from bearing support 30; second end bearing support 30 from head 26; two stage body 27 from head 26, rotor 14 from head 26 and cone 100 from head 26. Seals 110 and 112 would also be removed.

Once the pump 10 has been disassembled, a technician may re-assemble the liquid ring pump 10 using single-stage body 29 in place of two stage body 27; single stage cone 100*a* in place of two stage cone 100; single-stage rotor 14*a* in place of two stage rotor 14*c*, and single-stage shaft 16*a* in place of two stage shaft 16. The two-stage body 27 and two-stage shaft 16 have a length that is longer than that for single stage body 29 and shaft 16*a*. The technician may reassemble liquid ring pump to form a single stage pump 10' retaining the head 26, bearing supports 24 and 30, radial bearings 46, 52, axial bearing 50, end caps 22, 32, inner caps 48, 54, seals 110 and 112, prime mover, wiring, or and other fixed components used in the two stage pump 10.

The process of converting liquid ring pump 10' from a single-stage pump to a two stage pump is the reverse of the above in terms of what parts are kept. The technician replaces the single-stage body 29 with the two stage body 27; the single stage cone 100*a* with the two stage cone 100; the single-stage rotor 14*a* with the two stage rotor 14*c*, and the single-stage shaft 16*a* with the two stage shaft 16. The technician may reassemble liquid ring pump to form a two stage pump 10 retaining the head 26, bearing supports 24 and 30, radial bearings 46, 52, axial bearing 50, end caps 22, 32, inner caps 48, 54, seals 110 and 112, prime mover, wiring, or and other fixed components used in the single stage pump 10'.

The term gas as used herein is broad enough to include ambient air, mixtures of ambient air and other gasses, and mixtures of compressible and in compressible fluid such as for example air and water. As is evident from the foregoing description, certain aspects of the present invention are not limited to the particular details of the examples illustrated herein. It is therefore contemplated that other modifications and applications using other similar or related features or techniques will occur to those skilled in the art. It is accordingly intended that all such modifications, variations, and other uses and applications which do not depart from the spirit and scope of the present invention are deemed to be covered by the present invention.

Other aspects, objects, and advantages of the present invention can be obtained from a study of the drawings, the disclosures, and the appended claims.

We claim:

1. A liquid ring pump comprising:

a head having an inlet passage and a discharge passage;

a body of said liquid ring pump including a first stage working chamber and a second stage working chamber;

an inter-stage passage in fluid connection with a discharge outlet from said first stage working chamber, said inter-stage passage also in fluid connection with an inlet opening into said second stage working chamber;

an inter-stage discharge by-pass system comprising a by-pass passage from said inter-stage passage into said discharge passage of said head and at least a portion of a valve in fluid connection with said by-pass passage, said valve operable to allow a fluid to flow through said by-pass passage to substantially by-pass said second stage working chamber when a pressure within said by-pass passage is at or below a certain amount.

2. The liquid ring pump of claim 1 further comprising:

a cone coupled to said head, said cone including said inter-stage passage; and said cone having a flange with a head side and a body side, a passage extending through both said head side and said body side of said flange and forming part of said inter-stage discharge by-pass system; and said valve extending away from said head side of said flange and said inter-stage passage.

3. The liquid ring pump of claim 2 wherein said valve comprises a cage and a ball moveable within said cage; and wherein said by-pass passage is circular having a first diameter and said ball has a second diameter that is larger than said first diameter.

4. The liquid ring pump of claim 1 further comprising:

a liquid ring overload protection system comprising an overload relief passage from said second stage working chamber into said discharge passage of said head, said overload relief passage extending through a first side wall of said body and a wall of said head, said overload relief passage disposed radially within a curved outer surface of a continuously curved wall of said body.

5. The liquid ring pump of claim 1 wherein said body includes a first stage body section and a second stage body section; said first stage body section has a first lobe forming a first intake zone in said first stage working chamber, said first stage body section has a second lobe forming a second intake zone in said first stage working chamber;

said second stage body section has a first lobe and a second lobe, said first lobe forms a first intake zone of said second stage working chamber, said second lobe forms a second intake zone of said second stage working chamber;

said inlet opening into said second stage working chamber opens into the first intake zone in said second stage working chamber;

a second inter-stage passage is in fluid connection with a second discharge outlet from said first stage working chamber, said second inter-stage passage is in fluid connection with a second inlet opening which opens into the second intake zone of said second stage working chamber, said second inter-stage passage is in fluid connection with a second inter-stage discharge by-pass system.

6. A modular liquid ring pump having a first end and a second end, said liquid ring pump comprising:

a first end bearing support;

a head having an inlet passage and a discharge passage, said head coupled to said first end bearing support;

a body defining a working chamber;

a cone in fluid connection with said working chamber and with said inlet passage of said head, said working chamber in fluid communication with said discharge passage of said head;

a second end bearing support;

a shaft having a first end and a second end, said shaft journaled for rotation with a first bearing, said first bearing in said first end bearing support and said shaft journaled for rotation with a second bearing in said second end bearing support;

a rotor coupled to said shaft, said rotor having an impeller, a first radially extending wall bounding said impeller at one end of said impeller, a second radially extending wall bounding said impeller at a second end of said impeller, said impeller configured to rotate in said working chamber; and a drive system for rotating said shaft and said rotor;

wherein said body, said cone, said shaft, and said rotor at least partially define a two-stage group comprising a two-stage body, a two-stage cone, a two-stage shaft and a two-stage rotor, respectively;

said two-stage body forms said working chamber, said working chamber of said two stage-body includes a first stage working chamber and a second stage working chamber;

said two-stage cone has an inlet passage in fluid connection with said inlet passage of said head and said first stage working chamber;

said two-stage cone has an inter-stage passage in fluid connection with said first stage working chamber and said second stage working chamber;

said two-stage cone has a second stage discharge passage in fluid connection with said second stage working chamber and said discharge passage of said head; an said two-stage rotor includes said impeller, said impeller has a first stage impeller and a second stage impeller, said first stage impeller is bounded by said first radially extending wall and a divider wall, said second stage impeller is bounded by said divider wall and said second radially extending wall, and wherein said two-stage cone further comprises a flange; wherein said flange includes an inter-stage discharge by-pass system comprising a by-pass passage from said inter-stage passage of said two-stage cone and into said discharge passage of said head and at least a portion of a valve in fluid connection with said by-pass passage.

7. The modular liquid ring pump of claim 6 further comprising a liquid ring overload protection system comprising an overload relief passage in fluid connection with said discharge passage of said head and in fluid connection with said working chamber, and a second valve operable to allow liquid to flow through said overload relief passage when a liquid ring pressure in said working chamber exceeds a pre-determined amount, said liquid ring overload protection system disposed radially within an outer curved surface of a continuously curved wall of said body.

8. The liquid ring pump of claim 6, wherein said two-stage body includes a first stage body section and a second stage body section; said first stage body section has a first lobe forming a first intake zone in said first stage working chamber, said first stage body section has a second lobe forming a second intake zone in said first stage working chamber;

said second stage body section has a first lobe and a second lobe, said first lobe forms a first intake zone of said second stage working chamber, said second lobe forms a second intake zone of said second stage working chamber;

said inlet passage of said two-stage cone is in fluid connection with said first intake zone of said second stage working chamber, a second inlet passage of said two-stage cone in fluid connection with the second intake zone of said first stage working chamber said inter-stage passage of said two-stage cone is in fluid connection with the first intake zone of said second stage working chamber;

a second inter-stage passage of said two-stage cone is in fluid connection with a second stage inlet of said two-stage cone which opens into the second intake zone of said second stage working chamber, said second inter-stage passage is also in fluid connection with a first stage discharge outlet and a second inter-stage discharge by-pass system.

9. A liquid ring pump comprising a first end bearing support;

a head having an inlet passage and a discharge passage;

a body defining a working chamber;

a cone operable to place said at least one working chamber in fluid connection with said inlet passage and said discharge passage of said head;

a second end bearing support;

a shaft having a first end and a second end, said shaft journaled for rotation with a first bearing within said first end bearing support and said shaft journaled for rotation with a second bearing within said second end bearing support;

a rotor fixed to said shaft, said rotor comprising an impeller to rotate in said working chamber; and a drive system for rotating said shaft and said rotor; and a liquid ring overload protection system comprising an overload relief passage putting said discharge passage of said head in fluid communication with working chamber, and a mechanical valve operable to allow liquid to flow through said overload relief passage into said discharge passage of said head when a pressure exerted by a liquid ring in said chamber exceeds a pre-determined pressure, said liquid ring overload protection system disposed radially within an outer curved surface of a continuously curved wall of said body, wherein said body, said cone, said shaft and said rotor is one of a single-stage group comprising a single-stage body, a single-stage cone, a single-stage shaft and a single stage rotor, respectively, or a two-stage group, comprising a two-stage body, a two-stage cone, a two-stage shaft, and a two-stage rotor, respectively; and wherein said single-stage group and said two-stage group are interchangeable on said head.

10. The liquid ring pump of claim 9 wherein said overload relief passage comprises a passage through a sidewall of said body proximate a liquid ring portion of said working chamber and a formed passage through said inlet passage of said head.

11. The liquid ring pump of claim 9 wherein said mechanical valve is fixed to a divider wall of said head, said divider wall defining a portion of said discharge passage of said head.

* * * * *